US006604791B1

(12) United States Patent
Chen

(10) Patent No.: US 6,604,791 B1
(45) Date of Patent: Aug. 12, 2003

(54) RECLINING LEISURE CHAIR

(75) Inventor: Yuan-Chuen Chen, Chang-Hua Hsien (TW)

(73) Assignee: Hsin Hao Health Materials Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 10/115,711

(22) Filed: Apr. 5, 2002

(51) Int. Cl.[7] ..... A47C 1/02; A47C 1/024; A47C 20/00

(52) U.S. Cl. ..... 297/330; 297/83; 297/68; 297/318; 297/300.1; 297/300.2; 297/423.19; 297/325

(58) Field of Search ..... 297/68, 69, 300.1, 297/300.2, 423.19, 325, 330, 341, 88, 83, 317, 318, 320, 322, 342

(56) References Cited

U.S. PATENT DOCUMENTS 825,984 A * 7/1906 Schmersahl ..... 297/91
2,994,363 A * 8/1961 Fox ..... 297/322
4,696,512 A * 9/1987 Burnett et al. ..... 297/68
5,622,406 A * 4/1997 Meschkat et al. ..... 297/318
5,785,384 A * 7/1998 Sagstuen ..... 297/317
6,055,877 A * 5/2000 Welterlin et al. ..... 248/429
6,203,106 B1 * 3/2001 Nearing et al. ..... 297/329
6,390,546 B1 * 5/2002 Ming ..... 297/68
6,481,796 B1 * 11/2002 Chen ..... 297/329
2002/0101102 A1 * 8/2002 Chang ..... 297/330
2002/0121803 A1 * 9/2002 Schooler ..... 297/330
2002/0163236 A1 * 11/2002 Chen ..... 297/330

* cited by examiner

*Primary Examiner*—Peter M. Cuomo
*Assistant Examiner*—Sarah C. Burnham
(74) *Attorney, Agent, or Firm*—Harrison & Egbert

(57) ABSTRACT

A reclining leisure chair includes a base frame, a seat frame, a backrest frame, a hassock frame, a driving device, and a link rod. The driving device enables the seat frame and the backrest frame to be adjusted for reclining at the same time. The link rod is pivotally fastened at one end to the backrest frame, and at the other end with a pivoting portion of the seat frame. In conjunction with a control rod of the seat frame, the link rod enables the backrest frame to be adjusted for reclining independently. The hassock frame is pivoted with the link rod.

5 Claims, 9 Drawing Sheets

RECLINING LEISURE CHAIR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a leisure chair, and more particularly to a reclining leisure chair.

BACKGROUND OF THE INVENTION

As shown in FIG. 1, a prior art leisure chair comprises a movable backrest 10 and a movable seat 11, which can be adjusted for reclining by a reclining mechanism. The reclining mechanism of the prior art leisure chair enables the seat 11 to move at the same time when the backrest 10 is adjusted for reclining. However, the back and the waist of a person seated on the prior art leisure chair are subjected to great stress in the midst of a reclining action.

BRIEF SUMMARY OF THE INVENTION

The primary objective of the present invention is to provide a reclining leisure chair which is free of the deficiency of the prior art leisure chair described above.

In keeping with the principle of the present invention, the foregoing objective of the present invention is attained by a reclining leisure chair comprising a base frame, a seat frame, a backrest frame, and a driving device mounted on the base frame to enable the seat frame and the backrest frame to move simultaneously in such a manner that the back and the waist of a person seated on the reclining leisure chair are not subjected to pressure.

The reclining leisure chair of the present invention further comprises a hassock frame which is pivoted with one end of a link rod. The link rod is pivoted at other end with the backrest frame in conjunction with a control rod. The backrest frame can be thus adjusted for reclining independently of the seat frame.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
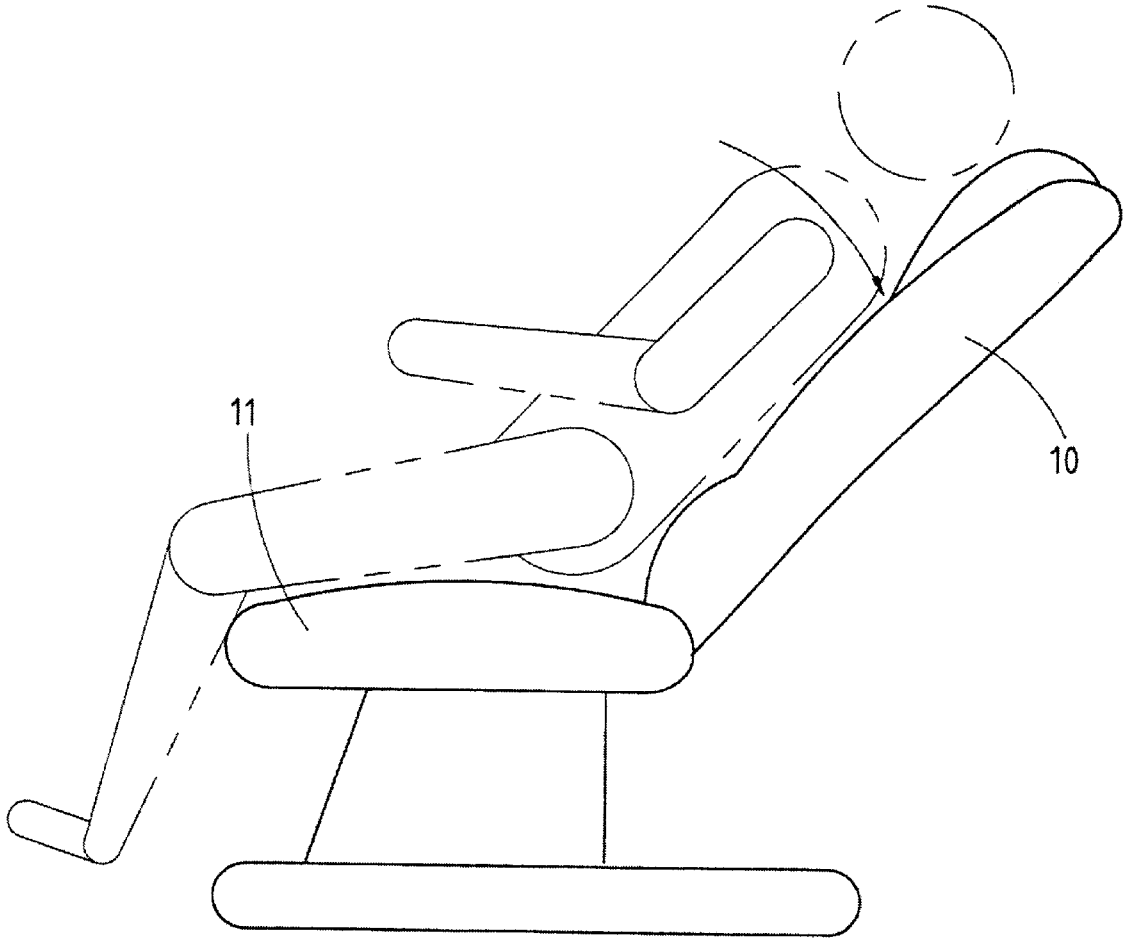
FIG.1 PRIOR ART
FIG. 1 shows a schematic view of a reclining leisure chair of prior art in use.
Figure 2:
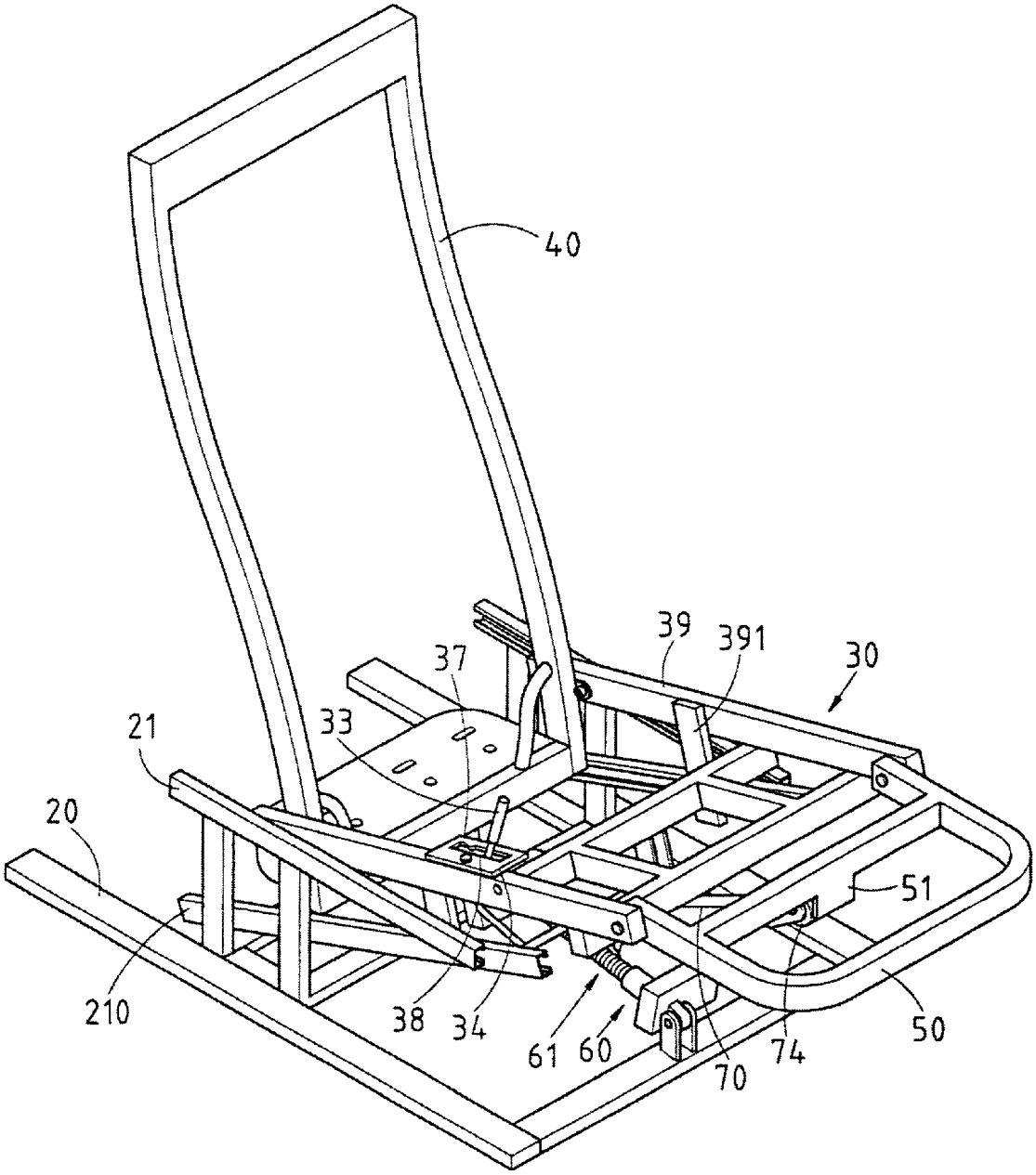
FIG. 2 shows a perspective view of the preferred embodiment of present invention.
Figure 3:
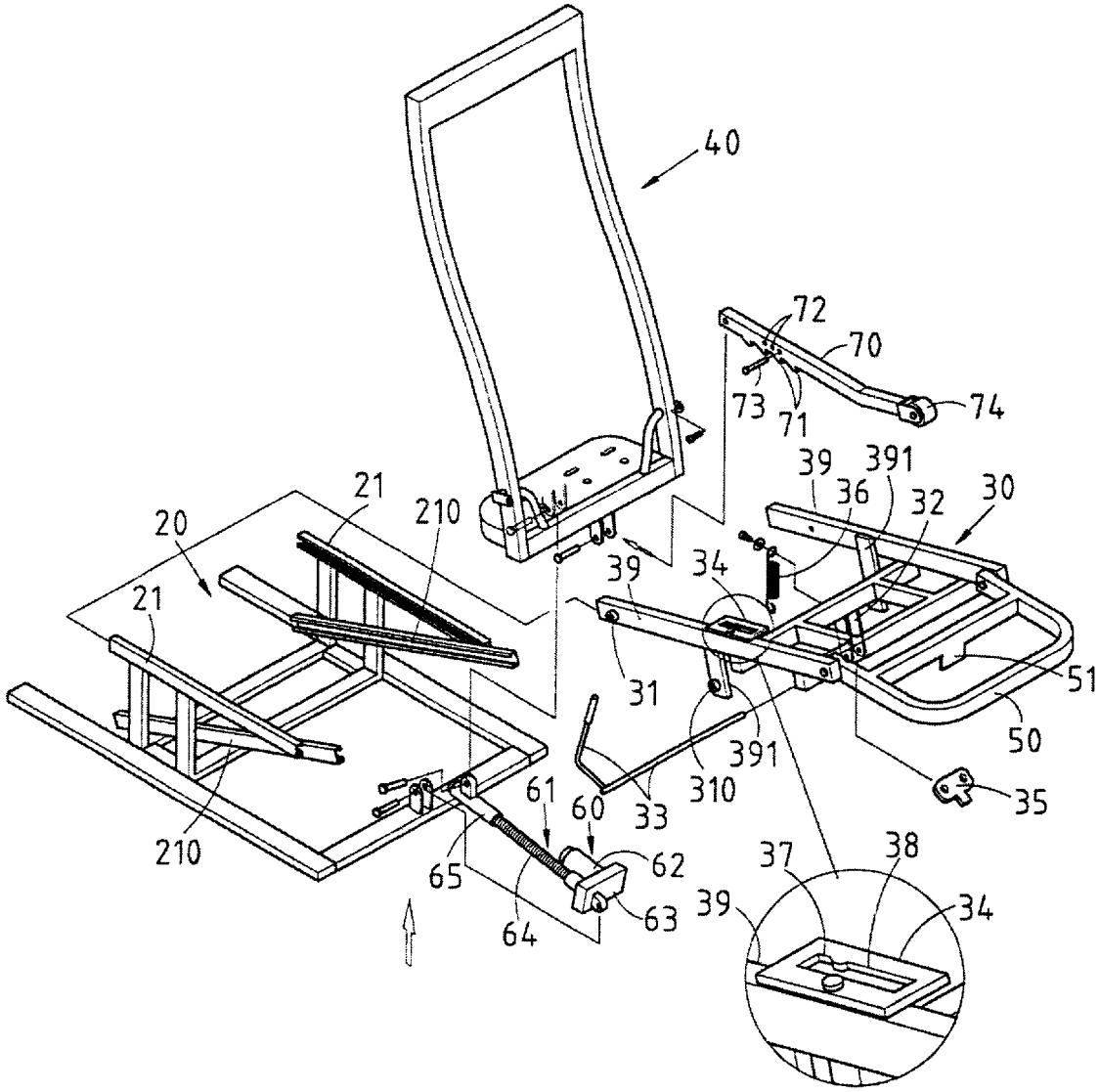
FIG. 3 shows an exploded perspective view of the preferred embodiment of the present invention.
Figure 4:
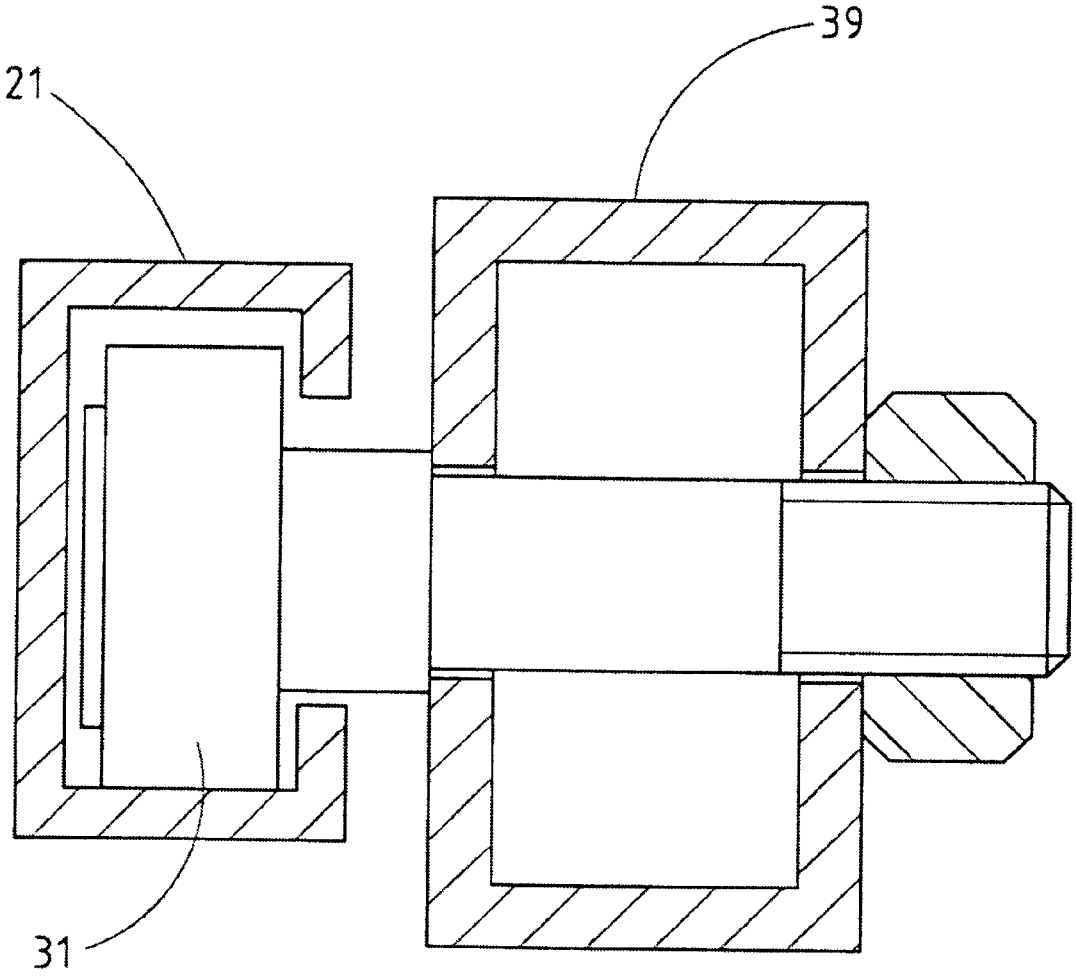
FIG. 4 shows a partial sectional view of the preferred embodiment of the present invention.

As shown in FIGS. 2–5, a reclining leisure chair embodied in the present invention comprises a base frame 20, a seat frame 30, a backrest frame 40, a hassock frame 50, a driving device 60, and a link rod 70.

The base frame 20 is provided in two longitudinal sides with a horizontal slide rail 21 and an inclined slide rail 210.

The seat frame 30 is formed of two longitudinal side rods 39 which are in turn provided at the rear end with a first roller 31, and in the midsegment with a roller frame 391 fastened therewith. The roller frame 391 is used to mount a second roller 310. The seat frame 30 is further provided in the midsegment of one of the two longitudinal side rods 39 thereof with a position confining piece 34 which is provided with a retaining edge 37 and a confining slot 38. The seat frame 30 is provided in the underside with a pivoting portion 32 and a control rod 33 which is pivoted with the pivoting portion 32 in conjunction with a switching piece 35 and a spring 36 urging the switching piece 35. The seat frame 30 is mounted on the base frame 20 such that the first rollers 31 of the side rods 39 of the seat frame 30 are slidably received in the horizontal slide rails 21 of the base frame 20, and that the second rollers 310 of the side rods 39 of the seat frame 30 are slidably received in the inclined slide rails 210.

The backrest frame 40 is mounted on the base frame 20 in conjunction with the link rod 70 which is pivoted at one end with the backrest frame 40 and at other end with the pivoting portion 32 of the seat frame 30. The link rod 70 is provided with a stopping portion 71 for stopping the switching piece 35, so as to enable the backrest frame 40 and the seat frame 30 to be adjusted simultaneously for reclining. The switching piece 35 can be caused by the control rod 33 to move away from the stopping portion 71 of the link rod 70, thereby enabling the backrest frame 40 to be adjusted independently for reclining.

The hassock frame 50 is fastened pivotally to the front end of the seat frame 30 and the other end of the link rod 70.

The driving device 60 is fastened with the base frame 20 and the seat frame 30 and is provided with an expansion piece 61 to enable the seat frame 30 and the backrest frame 40 to recline at the same time.

The driving device 30 is formed of a motor 62, a transmission member 63 driven by the motor 62, a threaded rod 64 actuated by the transmission member 63, and a threaded tube 65 fastened to the base frame 20. As the threaded rod 64 is actuated by the transmission member 63, the threaded rod 64 turns inside the threaded tube 65 to extract or retract.

Figure 5:
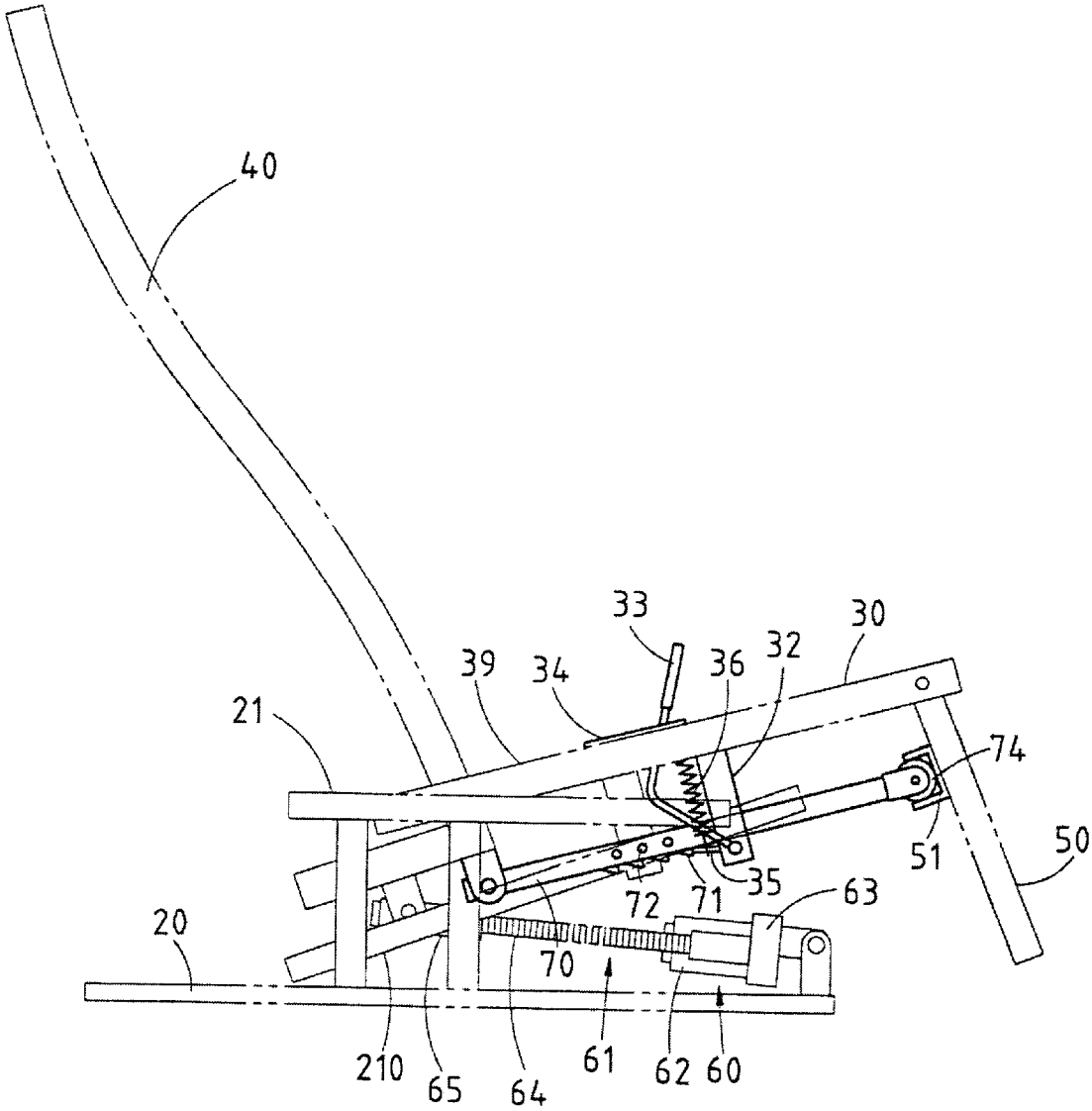
FIG. 5 shows a side elevation view of the preferred embodiment of the present invention.
Figure 9:
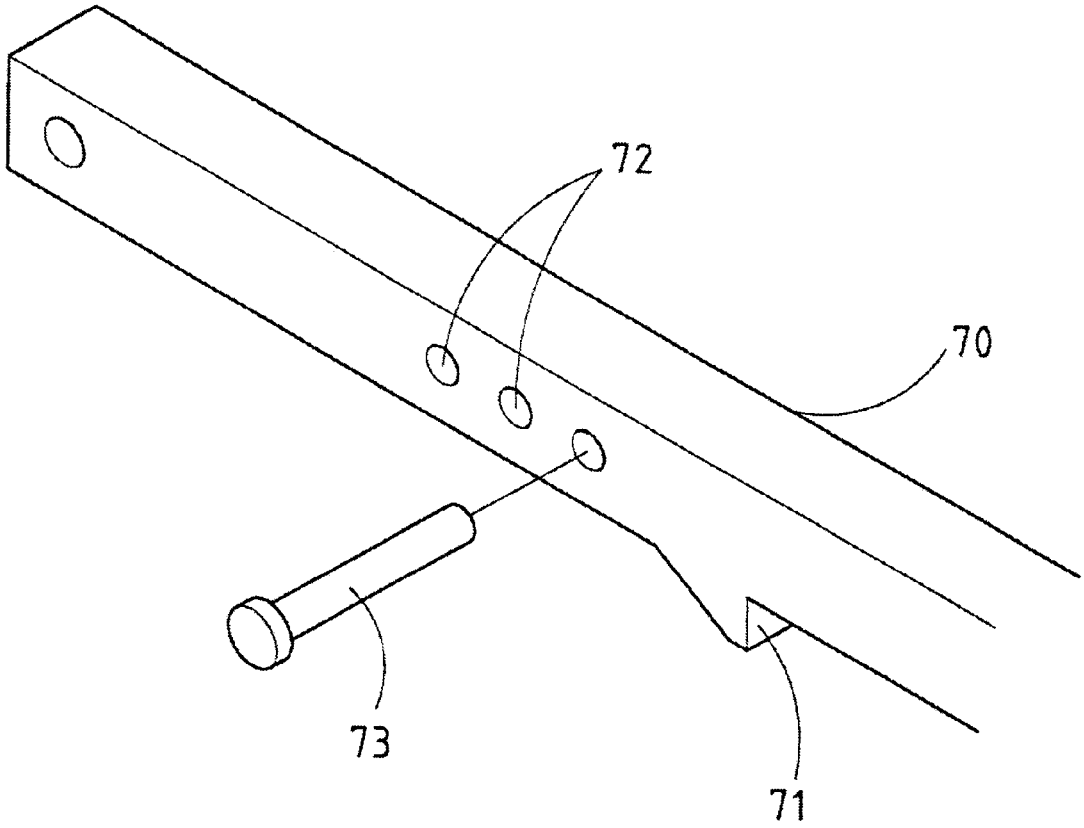
FIG. 9 shows an enlarged schematic view of the link rod of preferred embodiment of the present invention.

As shown in FIGS. 5 and 9, the link rod 70 is provided with a plurality of through holes 72 and a locating pin 73 which is put into one of the through holes 72 to locate the backrest frame 40 on the heels of the adjustment of the backrest frame 40 for reclining.

The link rod 70 is provided in proximity of one end with a movable wheel 74. The hassock frame 50 is provided with a receiving slot 51 for receiving the movable wheel 74 which is intended to reduce the mechanical friction between the link rod 70 and the hassock frame 50.

The position confining piece 34 of the sear frame 30 is provided with the confining slot 38 which is in turn provided with the retaining edge 37. The control rod 33 is located by the retaining edge 37.

Figure 6:
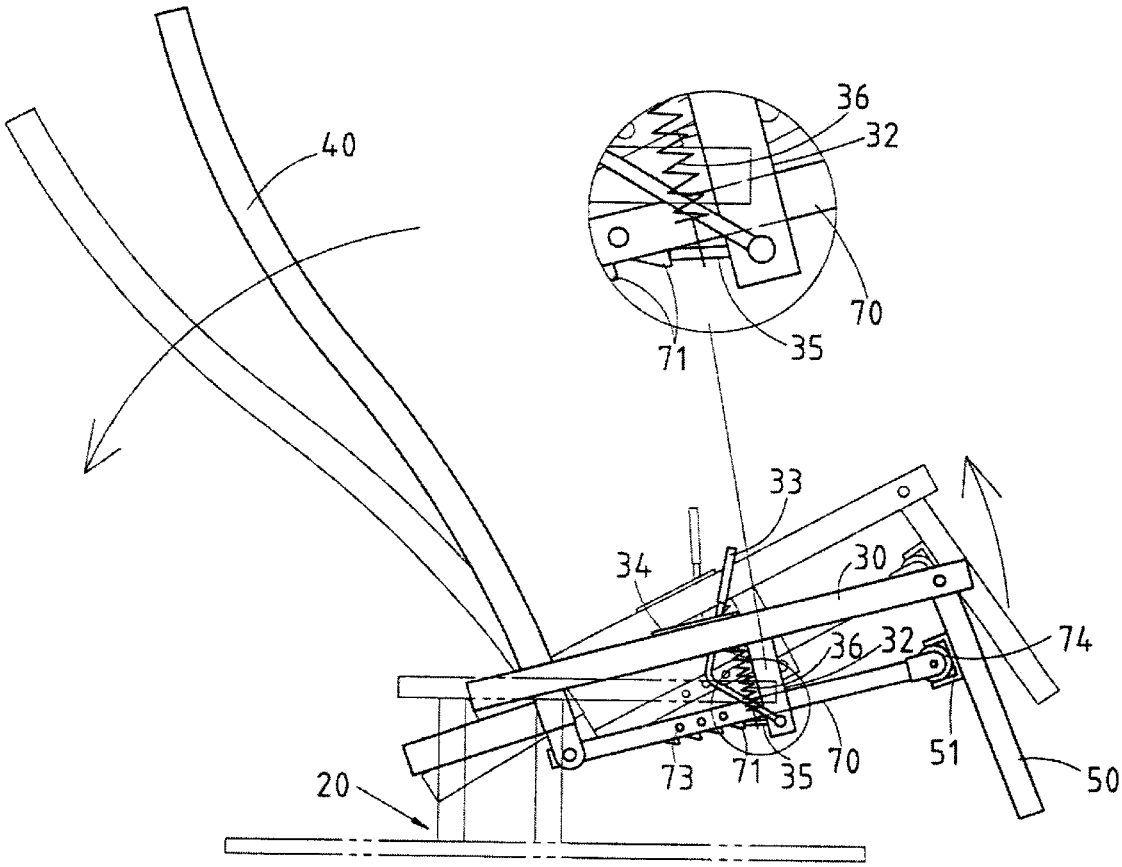
FIG. 6 shows a side schematic view of the preferred embodiment of the present invention in action.

As shown in FIG. 6, the spring 36 urges the stopping portion 71 of the link rod 70. The link rod 70 and the pivoting portion 32 of the seat frame 30 are engaged with each other. As a result, the seat frame 30 and the backrest frame 40 can be adjusted for reclining at the same time.

Figure 7:
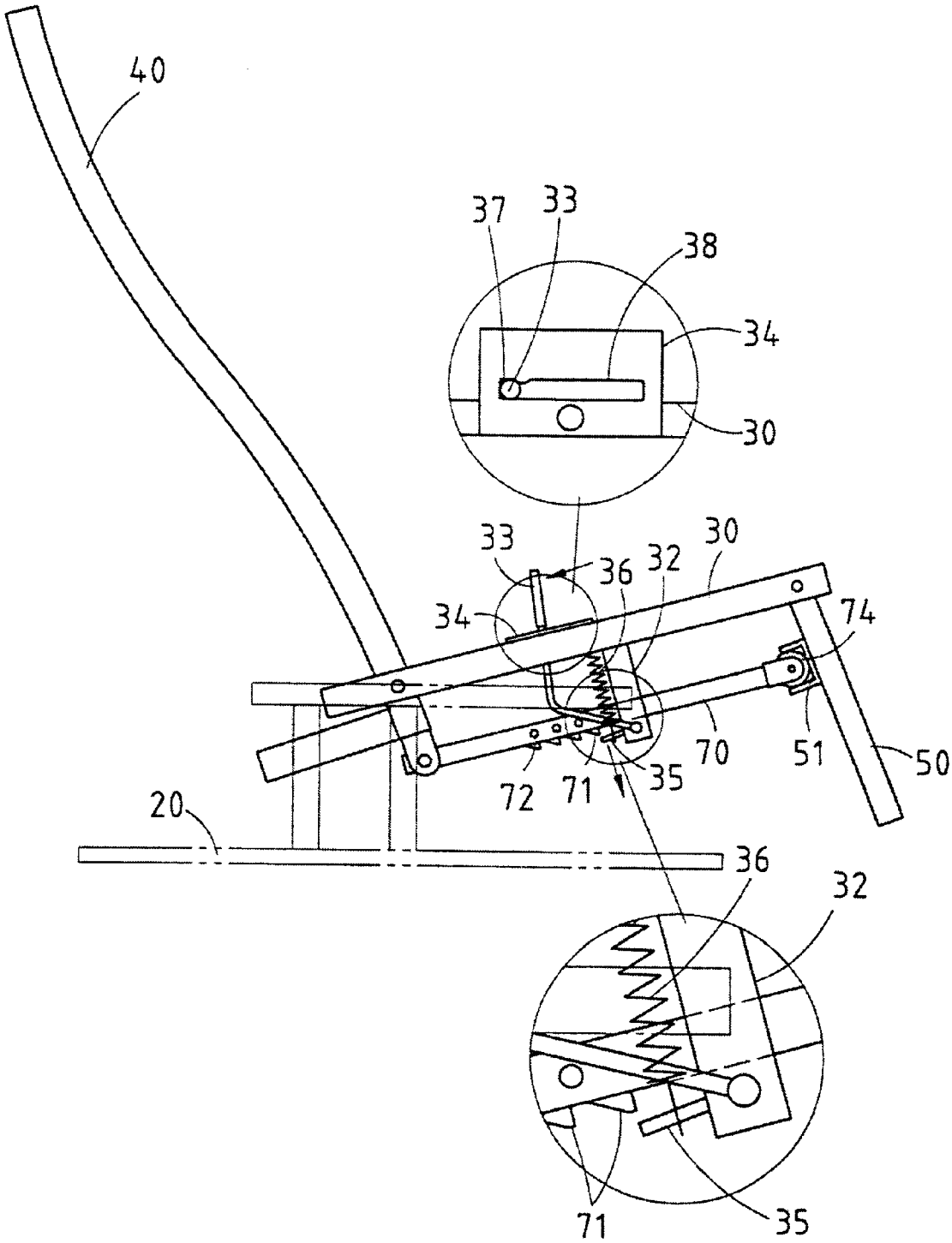
FIG. 7 shows another side schematic view of the preferred embodiment of the present invention in action.
Figure 8:
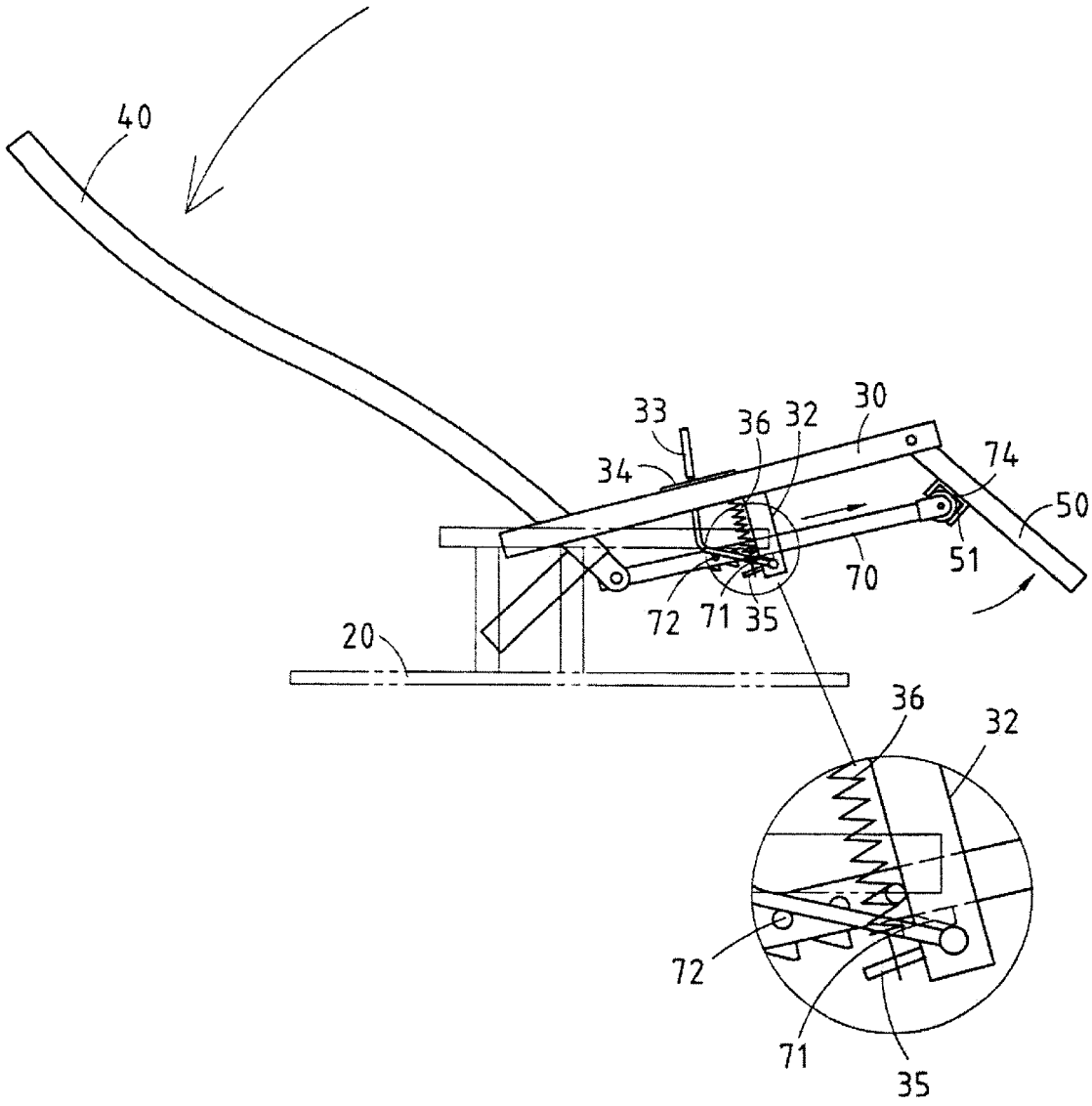
FIG. 8 shows another side schematic view of the preferred embodiment of the present invention in action.

As shown in FIG. 7, when the switching piece 35 is caused by the control rod 33 to move away from the stopping portion 71 of the link rod 70, the link rod 70 is disengaged with the switching piece 35, thereby enabling the link rod 70 to push the hassock frame 50 at the time when the backrest frame 40 is adjusted independently for reclining.

I claim:

1. A reclining leisure chair comprising:

a base frame having two longitudinal sides, each of said longitudinal sides having a horizontal slide rail and an inclined slide rail;

a seat frame having two longitudinal side rods, each of said longitudinal side rods having a first roller at a rear end thereof, said seat frame having a roller frame affixed at a midsegment thereof, said roller frame supporting a second roller thereon, said seat frame having a position confining piece at a midsegment of one of said two longitudinal side rods, said seat frame having a pivoting portion and a control rod at an underside thereof, said control rod pivoted with said pivoting portion, said seat frame having a switching piece and a spring, said seat frame being mounted on said base frame such that the first rollers are slidably received respectively in the horizontal slide rails of said base frame, the second rollers of said seat frame being slidably received respectively in the inclined slide rails of said base frame;

a backrest frame mounted to said base frame by a link rod, said link rod pivoted at one end to said backrest frame and at an opposite end with said pivoting portion of said seat frame, said link rod having a stopping means thereon for stopping said switching piece so as to enable said backrest frame and said seat frame to be adjusted simultaneously for reclining, said control rod cooperative with said switching piece so as to cause said switching piece to move away from said stopping means to enable said backrest frame to be independently adjusted for reclining;

hassock frame pivotally fastened to said seat frame and said link rod; and a driving means fastened to said base frame and said seat frame, said driving means having an expansion piece for enabling said seat frame and said backrest frame to recline simultaneously.

2. The reclining leisure chair of claim 1, said driving means comprising:

a motor;

a transmission member driven by said motor;

a threaded rod drivingly rotatably connected to said transmission member; and a threaded tube fastened to said base frame such that said threaded rod is rotatably positioned within said threaded tube.

3. The reclining leisure chair of claim 1, said link rod having a plurality of through holes formed therein and a locating pin inserted into one of said plurality of through holes for positioning said backrest frame.

4. The reclining leisure chair of claim 1, said link rod having a movable wheel affixed thereto, said hassock frame having a receiving slot receiving said movable wheel therein.

5. The reclining leisure chair of claim 1, said position confining piece of said seat frame having a confining slot with a retaining edge, said retaining edge of said confining slot receiving said control rod therein.

* * * * *